US008166718B2

(12) United States Patent
Liu

(10) Patent No.: US 8,166,718 B2
(45) Date of Patent: May 1, 2012

(54) HORIZONTALLY ENGINEERED HARDWOOD FLOOR AND METHOD OF INSTALLATION

(76) Inventor: David C. Liu, Marietta, GA (US)

( * ) Notice: Subject to any disclaimer, the term of this patent is extended or adjusted under 35 U.S.C. 154(b) by 523 days.

(21) Appl. No.: 12/249,522

(22) Filed: Oct. 10, 2008

(65) Prior Publication Data

US 2010/0088990 A1 Apr. 15, 2010

(51) Int. Cl.
*E04F 15/22* (2006.01)

(52) U.S. Cl. ..... 52/403.1; 52/309.13; 428/50

(58) Field of Classification Search ..... 52/309.13, 52/783.1, 782.1, 630, 403.1; 428/50, 47, 428/55

See application file for complete search history.

(56) References Cited

U.S. PATENT DOCUMENTS 2,092,694 A * 9/1937 Crooks ..... 52/366
2,751,946 A * 6/1956 Gramelspacher ..... 144/350
2,772,197 A * 11/1956 Kozdemba ..... 156/331.3
4,170,859 A * 10/1979 Counihan ..... 52/779
4,233,793 A * 11/1980 Omholt ..... 52/390
4,635,425 A * 1/1987 Cova ..... 52/480
4,819,932 A * 4/1989 Trotter, Jr. ..... 472/92
5,098,762 A * 3/1992 Nakajima ..... 428/106
5,396,750 A * 3/1995 Kleyn ..... 52/792.11
5,412,917 A * 5/1995 Shelton ..... 52/403.1
6,122,873 A * 9/2000 Randjelovic ..... 52/403.1
6,536,171 B1 * 3/2003 Vandewater ..... 52/302.1
7,152,379 B2 12/2006 Lin
7,210,276 B1 * 5/2007 Kraft et al. ..... 52/747.11
7,225,591 B2 6/2007 Lin
7,452,433 B2 * 11/2008 Shin et al. ..... 156/71
7,703,252 B2 * 4/2010 Randjelovic ..... 52/403.1
7,926,239 B2 * 4/2011 Hahn et al. ..... 52/592.1

* cited by examiner

*Primary Examiner* — Eileen D Lillis
*Assistant Examiner* — Alp Akbasli
(74) *Attorney, Agent, or Firm* — Wang Law Firm, Inc.; Li K. Wang

(57) ABSTRACT

Horizontally engineered floor boards are provided by this invention. The floor board includes a top decorative layer placed on a plurality of strips. The plurality of strips are arranged to have some in X-axis orientation and some in Y-axis orientation. The plurality of strips also has characteristics that allow the wood floor board to be installed as a tile.

18 Claims, 11 Drawing Sheets

A-A View

A-A View

A-A View

B-B View

2600

2700

2800

HORIZONTALLY ENGINEERED HARDWOOD FLOOR AND METHOD OF INSTALLATION

FIELD OF THE INVENTION

The invention relates to wood flooring, and more particularly, to water resistant flexible floor board.

BACKGROUND OF THE INVENTION

Conventional engineered hardwood floor is engineered by stacking a top high quality decorative veneer on multilayer of less quality veneers. These layer veneers are normally glued layer by layer in perpendicular directions. One layer on X direction, and next layer will be on Y direction. The dimensional stability of conventional engineered hardwood floor is achieved by cross wood grain veneer to balanced stress created by moisture in X and Y direction and balance of stress between top and bottom layers in Z direction.

The surface layer often requires thicker for resanding purpose. This makes the engineered floor imbalanced in top and bottom layer in Z direction. As moisture changes, the floor will warp, cure, or buckle, even delaminate due to imbalanced stress. Especially, when the engineered floor is glued down by urethane glue, which absorbs water as it cures, the glue could absorb water from engineered floor from bottom layers and results delamination of top layers at installation.

The conventional engineered floor delamination is often caused by weak bonding between layers of veneers. The weak bonding may stem from over cured glue, uneven spread of curing agent, or manufacturing miscontrol. This weak bonding is not detectable until the floor is delaminated under high stress. Multilayers of glue increase the odds of a floor having weak bonding spots.

Therefore, there is a need for engineered floor to reduce or eliminate delamination. In contrast to conventional engineered floor, which is engineered vertically with cross wood grain veneers, the present of invention offers horizontally engineered floors to reduce and eliminate delamination.

SUMMARY OF THE INVENTION

The present invention provides a High Performance Engineered (HPE) floor board resistant to both high and low humidity environment. The HPE floor board comprises a top wood layer, a plurality of supporting strips, and a water resistant adhesive layer. The top wood layer has wood grain lined up along the length of the floor board and also has a top surface and a bottom surface. The plurality of supporting strips is attached under the top wood layer. The water resistant adhesive layer is placed between the top wood layer and the plurality of supporting strips and covers the bottom surface of the top wood layer.

In another embodiment of the invention there is provided a water resistant composite tile. The water resistant composite tile comprises a masonry block with a recessed area, a water resistant board with a top wood layer, a plurality of supporting strips attached to the top wood layer, and a water resistant adhesive layer placed between the top wood layer and the plurality of supporting strips. The top wood layer is attached to the recessed area of the masonry block.

In yet another embodiment of the invention there is provided a composite HPE floor panel. The HPE floor panel comprises a first HPE floor board placed along a length of the panel, a second HPE floor board attached to the first HPE floor board, and a third HPE floor board attached to the second HPE floor board. The second HPE floor board is longitudinally offset from the first floor board. The third HPE floor board is aligned with the first HPE floor board.

In yet another embodiment of the invention, there is provided a HPE floor board. The HPE floor board comprises a top wood layer having a length and a base supporting wood layer glued longitudinally to the top wood layer along the length. The base supporting wood layer has a plurality of supporting strips and each supporting strip having at least one groove transversal to the length of the top wood layer.

A method for installing floor boards on a surface that comprises the steps of attaching an underlayment with a plurality of spacers on the surface, placing the floor boards on the underlayment, and securing each floor board through the plurality of spacers.

A method for installing composite floor tiles on a surface, wherein each composite floor tile is made from a masonry tile and a wood floor board. The method comprises the steps of spreading a layer of mortar on the surface and placing the composite floor tiles on the top of the mortar layer.

BRIEF DESCRIPTION OF THE DRAWINGS

Features and advantages of embodiments of the invention will become apparent as the following Detailed Description proceeds, and upon reference to the Drawings, where like numerals depict like elements, and in which.

DETAILED DESCRIPTION OF THE INVENTION

The present invention provides a HPE hardwood floor board and method of installation of such. A major problem with a traditional multi-layer hardwood floor board is delamination resulting from the imbalanced stress in vertical direction (z direction) between the top layer and the bottom layer. The stress can stem from a thick surface layer, moisture loss in the top layer, or glue onto the bottom layer. The multi-layers of glue applied to a multi-layer hardwood floor also likely have some weak bonding areas due to glue in some area did not cure properly, uneven mixing of glue, or some other failure in the manufacturing process. The stress could break up the weak bonding areas and start the delamination process.

The present invention solves this problem by eliminating vertical engineering and permits the floor to be flexible without balancing the stress between the top layer and the bottom layer. The HPE floor is stabilized by horizontally engineering in XY direction on bottom layer(s) of floor. The HPE floor consists of only two layers which reduces of odd of weak bonding for delamination. The HPE floor board reduces internal stress by not constraining the hardwood floor board. The HPE floor board body (the second layer) is allowed to expand and contract because gaps between the strips.

Figure 1:
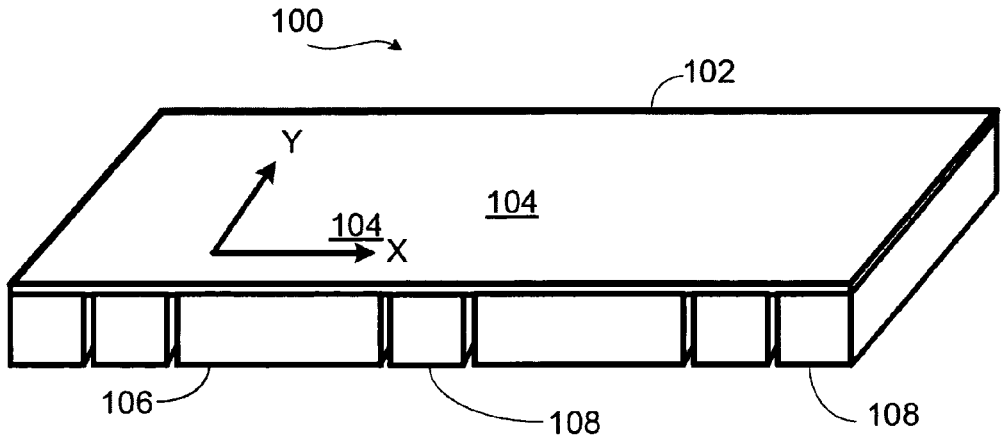
FIG. 1 is a perspective view of a HPE floor board according to one embodiment of the invention.
Figure 18:
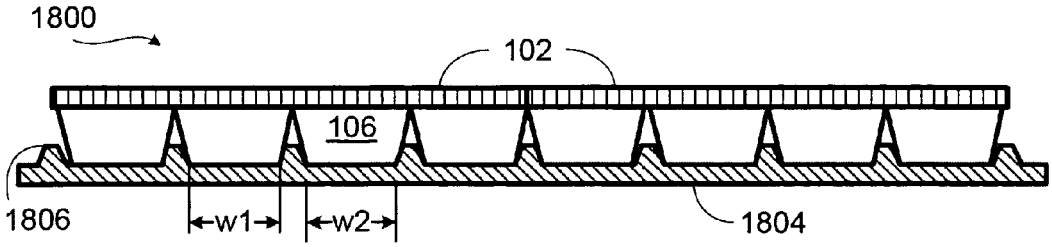
FIG. 18 is a cross section view of a hardwood floor installation using a special underlayment.

FIG. 1 is a perspective view 100 of a floor board 102. The floor board 102 has a top wood layer 104 and a layer of supporting strips 106 in X-direction and 108 in Y-direction, X-direction being longitudinal to the length of the floor board and Y-direction being transversal to the length of the floor board. The layer of supporting strips 106, 108 is attached to the bottom side of the top wood layer 104. The top wood layer 104 is made usually from high quality wood with a decorative appeal and optionally coated with a water resistant coating. The wood grain of the top wood layer 104 is generally aligned in the X direction. The thickness of the top wood layer 104 is between 1-10 mm, preferably 2-6 mm; however, in some situation, the thickness can be as thick as 4-10 mm if resanding is desired. The supporting strips 106, 108 are attached to the top wood layer 104 through an adhesive layer 302 (shown in FIG. 3). The adhesive layer is a layer of water resistant glue, which effectively seals the bottom side of the top wood layer 104. The top layer can be a wood veneers, plastic wear layer, metal composite, or paper/plastic composite deco layer. The strips 106, 108 can be made from hardwood, soft wood, oriented strand board (OSB), plastic, rubber, foam, fiber glass, cement, tiles, porcelain, stone tile, glass, wood/plastic composite, fiber board, silicate composite, bamboo, or other man-made material. The strips 106, 108 may have a rectangular profile as shown in FIG. 1, trapezoid profile as shown in FIG. 18, or other suitable formats. The thickness of the strip can be 4-20 mm, preferably 10-15 mm. The strips 106, 108 are optionally attached first to a mesh 202 (shown in FIG. 2), which can then be attached to the top wood layer 104. The HPE floor board 102 can be glued or nailed onto a subfloor surface; it can also be installed as a tile using mortar if the strips 106 are made from tiles cement, tiles, porcelain, stone, glass, or other man made materials.

Figure 2:
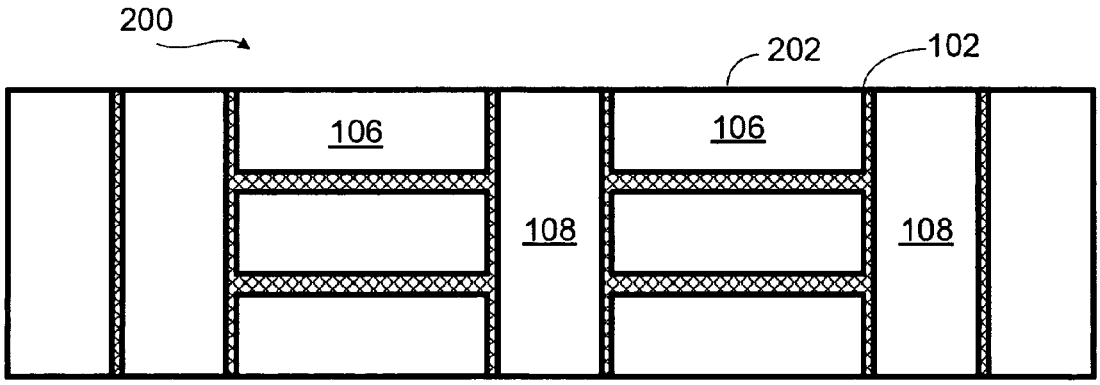
FIG. 2 is bottom view of a HPE floor board.
Figure 22:
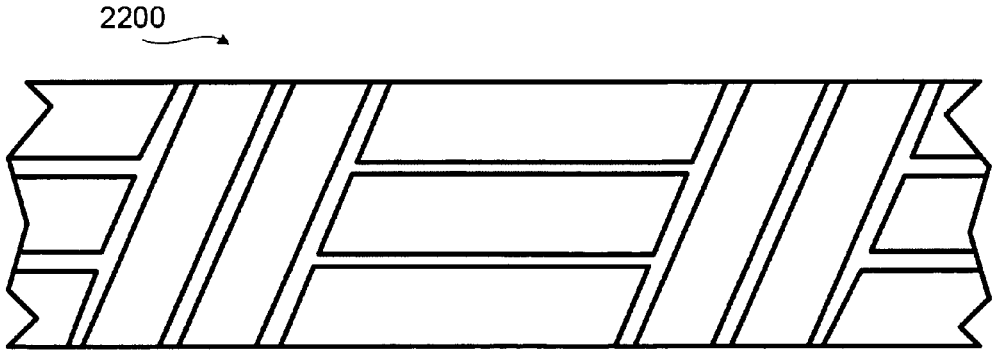
FIG. 22 depicts layout of a supporting strips in oblique direction.

FIG. 2 is a bottom view 200 of a HPE floor board 102. A plurality of supporting strips 106, 108 are attached to a mesh or tape 202 and then glued to the bottom of the floor board 102. Alternatively, the support strips 106, 108 may be glued directly onto the top wood layer 104 with a thick glue layer. The floor board 102 can be affixed through nailing or staple when the supporting strips 106 are made from wood or composite wood. The strips 106, 108 are placed separated from each other, thus allowing a limited flexibility to the floor board 102, and the gaps between strips prevent the propagation of the stress from one strip to another strip. The supporting strips 106, 108 may be lined up in the Y direction, X direction, or a mix of two directions as shown in FIG. 2. The supporting strips 106, 108 may also be installed in oblique direction as shown the assembly 2200 in FIG. 22. By lining up the supporting strips in Y direction, as supporting strips 108, or in X-direction, as supporting strips 106, HPE floor board 102 will not be wrap and remain relative flexible in Y direction as well. This is important to wide boards or square shape floor boards. Because of the gaps, the expansion of the support strip 108 in X direction will be allowed, and the floor board will remain stable. The length and gap width of the strip 106 allow HPE floor board flexibility to be controlled in X direction. If it is too stiff, the HPE board will not be easily glued down on an uneven subfloor; if it is too flexible, the HPE board will not offer enough mechanical strength. The strips 106 also provide good grip to nails as solid hardwood, which is unique property that other conventional engineered floor does not offer.

Because expansion is allowed, the tension within multiple layers of the floor board 102 is also minimized and isolated. Because HPE floor board is strengthened in both X and Y directions with the strips 106, 108, the HPE floor board is also dimensionally stabilized. Because of only two layers, the weak areas of the glue are also likely reduced compared to multi-layers of glues. With this new engineered approach, the problem of delamination is reduced or even eliminated.

Figure 31:
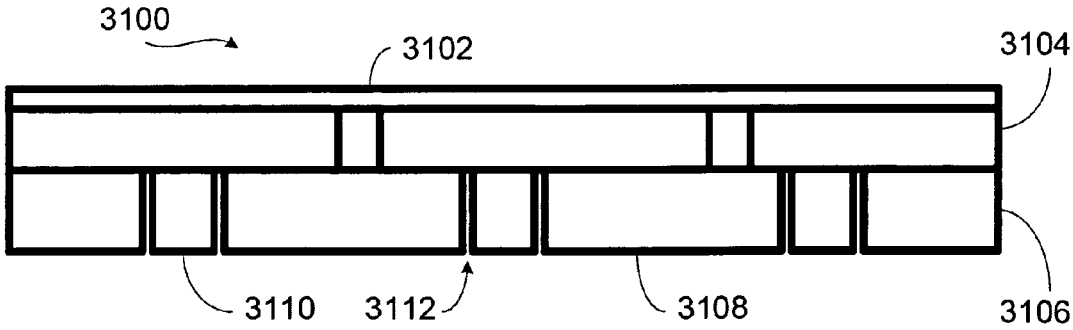
FIG. 31 illustrates a special construction of a top layer according to one embodiment of the invention.

The same principle may be also applied to the top layer. If the topic layer is too thin, 0.3-2 mm, it loses its mechanical strength and will not able to bind to the second layer. FIG. 31 shows a floor board 3100 with a top layer can constructed from two layers, one is a thin top decorative layer 3102 that ranges from 0.3 mm-2 mm, and the base supporting layer 3104 of the top layer can be engineered horizontally without gaps. They are glued together seamlessly to support the top deco layer 3102. The top two layer structure can range from 2-15 mm. The base supporting layer 3104 has no gap, and the Y direction pieces need to be narrow to avoid excessive expansion in X direction on this layer. There is third layer 3106 placed under the base supporting layer 3104. The third layer 3106 has a plurality of strips 3108, 3110 placed in X and Y directions. There are grooves 3112 on the third layer 3106 formed by the gaps between the strips 3108 and 3110. Alternatively, the third layer 3106 maybe formed without any gap.

Figure 3:
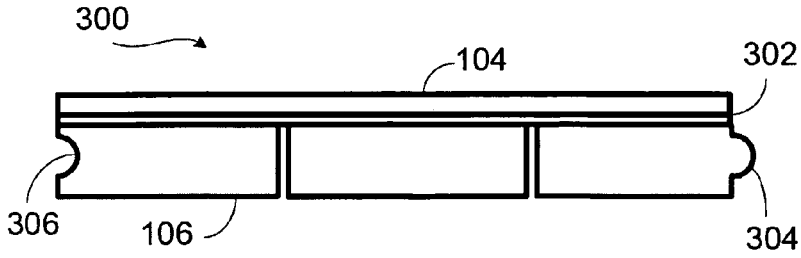
FIG. 3 is a cross section view of a HPE floor board.
Figure 4:
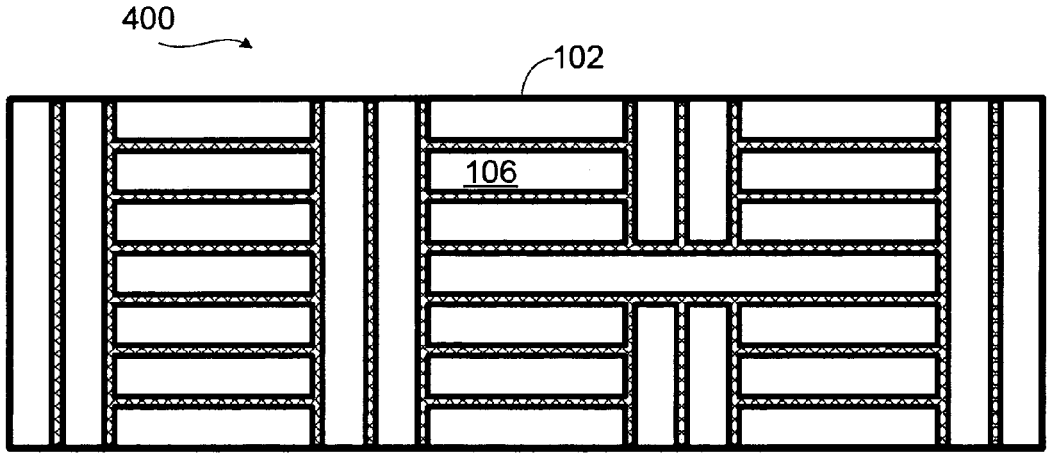
FIG. 4 depicts one possible arrangement of supporting strips.
Figure 23:
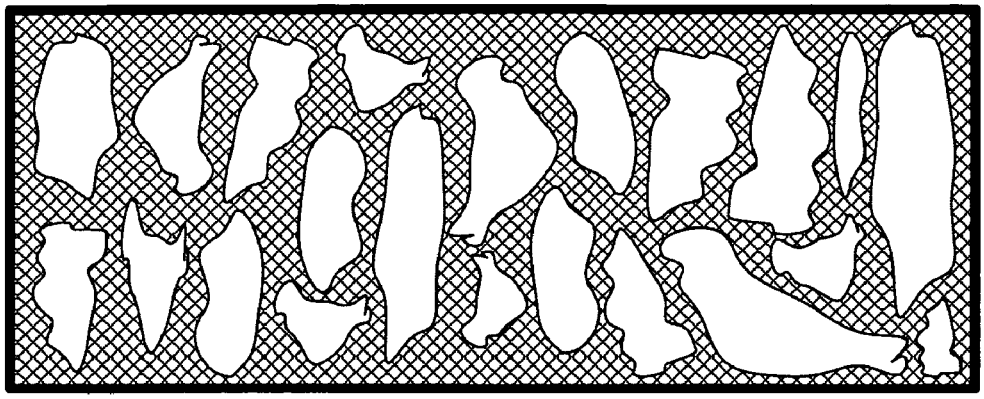
FIG. 23 illustrates a plurality of supporting strips in a mosaic configuration.

FIG. 3 is a cross section view 300 of a floor board 102. The top thin wood layer 104 of the floor board 102 is attached through a water resistant adhesive layer 302 to a layer of supporting strips 106. The floor board 102 has a locking lip 304 and a recessed slot 306. The locking lip 304 and recessed slot 306 enable two adjacent floor boards 102 be tightly secured. FIG. 4 illustrates another configuration of supporting strips 106 on a floor board 102. By configuring the supporting strips 106 differently, the floor board 102 may achieve different level of flexibility in both X and Y directions. For example, multiple longer supporting strips 106 along the X direction will make the floor board 102 less flexible, and more supporting strips 106 along the Y direction will make floor board 102 more flexible. The supporting strips 106 need not to have regular forms; they can have random shapes made from recycled materials and distributed randomly as a mosaic on a mesh as shown in FIG. 23.

Figure 24:
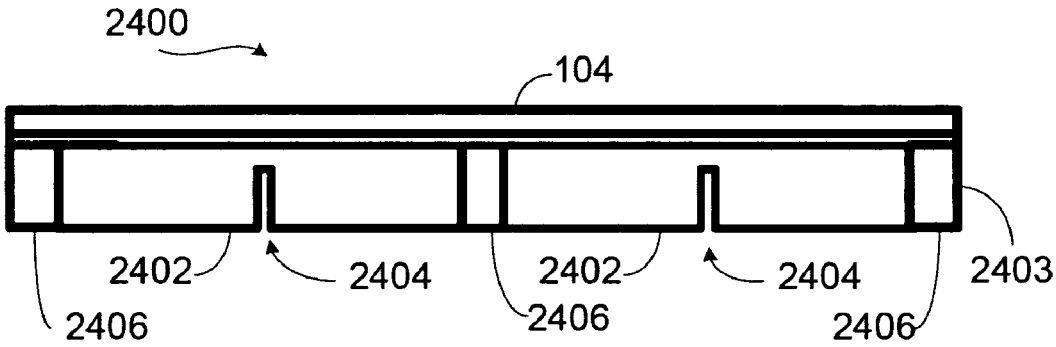
FIG. 24 illustrates a cross section of a floor board according to an alternative embodiment.
Figure 25:
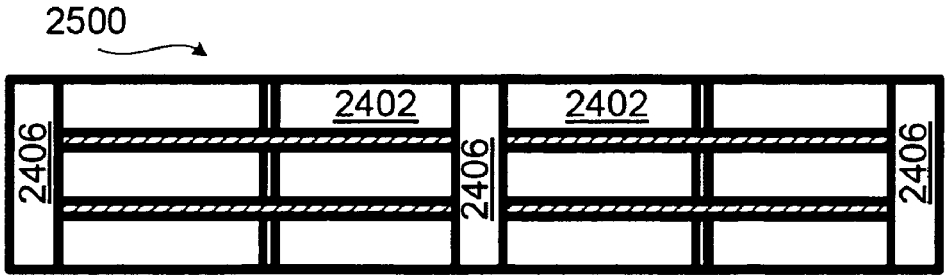
FIG. 25 illustrates the bottom view of the floor board of FIG. 24.
Figure 26:
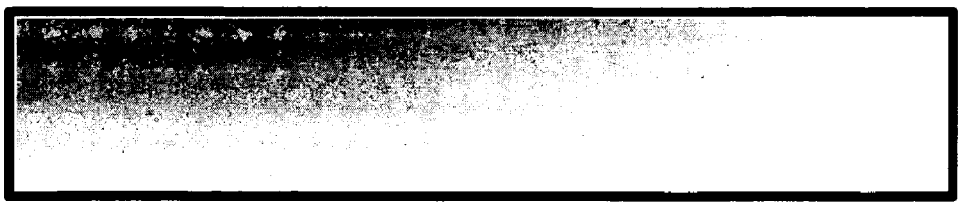
FIG. 26 illustrates an assembled top layer.
Figure 27:
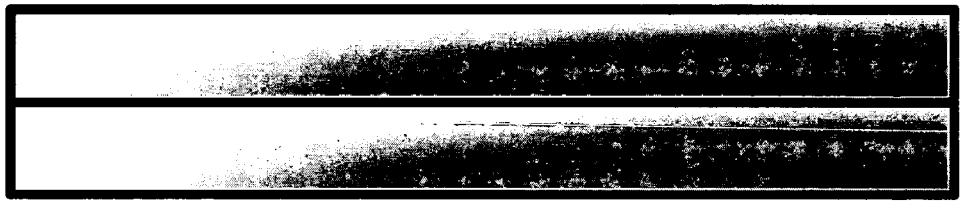
FIG. 27 illustrates another embodiment of the assembled top layer.
Figure 28:
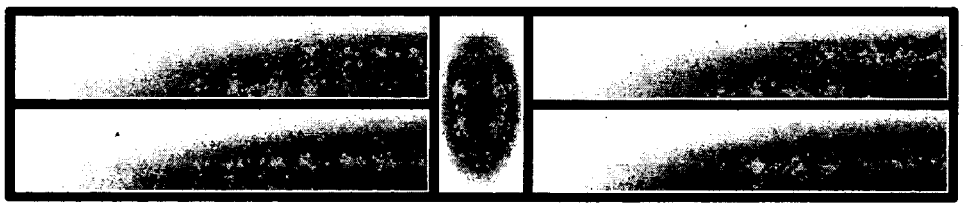
FIG. 28 illustrates yet another embodiment of the assembled top layer.

The supporting strips need not to be separated from each other with gaps. FIG. 24 illustrates the cross section of a floor board 2400 according to one alternative embodiment of the invention. The floor board 2400 has a top thin wood layer 104 and a plurality of supporting strips 2402 forming a supporting layer 2403. The supporting layer 2403 is engineered in X and Y directions with strips similar to strips 2402 and 2406, and these strips are glued together. The gap is achieved by open grooves in the supporting layer 2403, and generally the grooves 2404 are opened on the strips 2402 in X direction. The supporting strips 2402 and the groove 2404 may be coated to prevent moisture penetration. This structure does not use the mechanical strength from the top layer 104; the mechanical strength is offered by the supporting layer 2403 and flexibility is offered by the grooves 2404, which preferable do not severe completely the supporting strips into multiple pieces. This engineering approach will permit the top layer 104 be very thin, e.g. 0.3 mm-2 mm, and it can work on thick surface, such as 2-10 mm, as well. FIG. 25 illustrates a bottom view of the floor board of FIG. 24.

Figure 29:
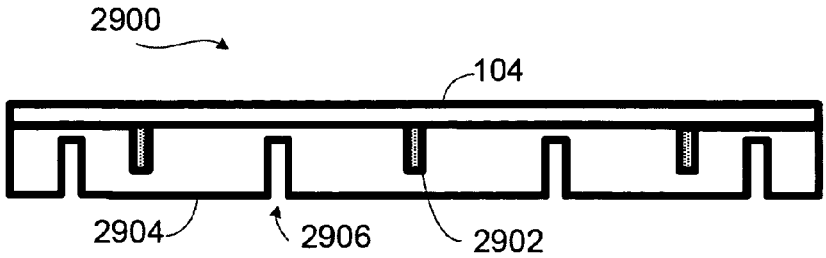
FIG. 29 illustrates a cross section of a floor board according to an alternative embodiment.
Figure 30:
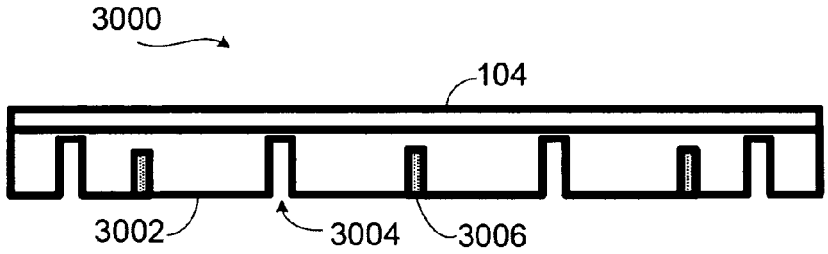
FIG. 30 illustrates a cross section of a floor board according to yet another alternative embodiment.

FIGS. 29 and 30 illustrate cross section view of alternative embodiments of the invention. The floor board 2900 of FIG. 29 has a thin top wood layer 104 attached to a supporting board 2904 placed longitudinally along the length of the floor board 2900. On the board 2904 a plurality of grooves 2906 are opened from the bottom in both X and Y directions. A second plurality of supporting thin strips 2902 are placed transversally and seamlessly along the length of the floor board 2900. Longitudinal supporting strips 2904 and transversal supporting strips 2902 are attached to the top wood layer 104. The transversal supporting strips 2902 may be embedded in the longitudinal supporting strips 2904. Each longitudinal supporting strip 2904 may have a plurality of grooves 2906 similar to the grooves of FIG. 24. The width of the transversal strip is 1-15 mm, preferably 2-10 mm. FIG. 30 illustrates a floor board 3000 according to another embodiment of the invention. The transversal supporting strips 3006 are not directly attached to the tope wood layer 104; instead, the transversal supporting strips 3006 are attached to the longitudinal supporting strips 3002 opposite of the top wood layer 104. The longitudinal supporting strips 3002 have also grooves 3004 similar to those in FIG. 24.

Figure 5:
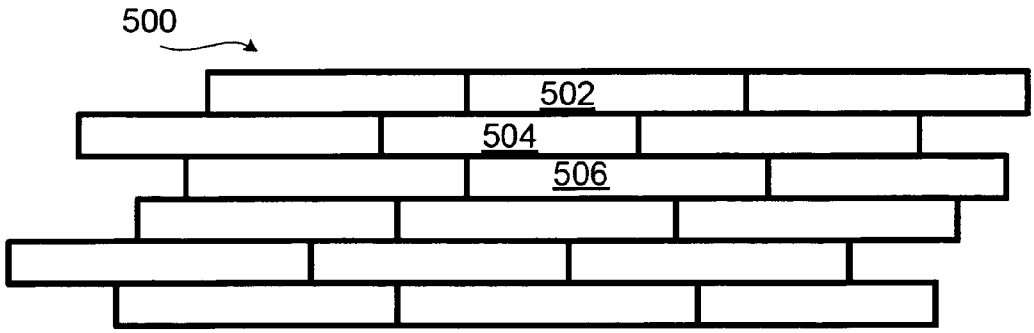
FIG. 5 illustrates a hardwood floor installed with composite floor panels of the present invention.
Figure 6:
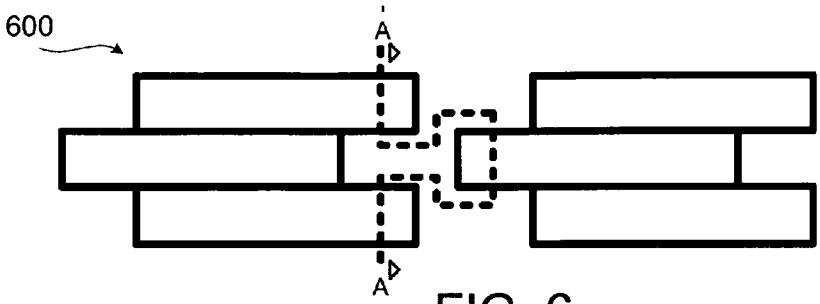
FIG. 6 assembling of two composite floor panels.

One of the shortcomings of the multi-strip engineered floor boards is their appearance. Usually the engineered floor boards have identical length and they form blocs of square pattern easily identified as engineered floor or laminated floor after installed. FIG. 5 illustrates a hardwood floor 500 installed with composite floor panels that present an improved appearance as installed using real random length single planks installed. In FIG. 5, floor boards 502, 504, and 506 form a composite floor panel and the hardwood floor 500 is formed with multiple composite floor panels. Because of the special arrangement of floor boards 502, 504, and 506, there is no readily identifiable blocs of square patterns on the hardwood floor 500. FIG. 6 illustrates assembly 600 of two composite floor panels. Though three floor boards form a pattern shown in FIG. 6, it is understood that other patterns may also be formed with floor boards that do not present readily identifiable blocs of square patterns.

Figure 7:
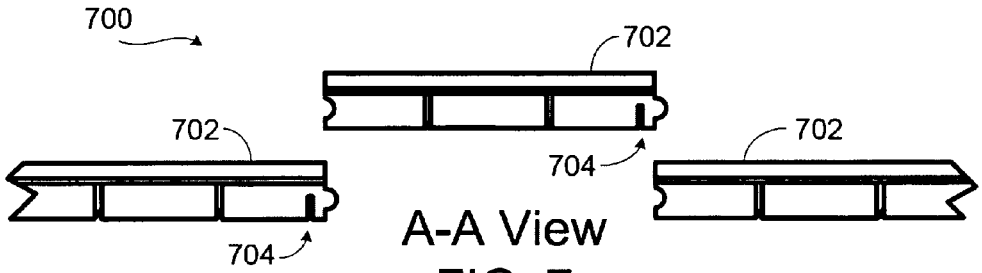
FIGS. 7-9 depict engagement of two floor boards.
Figure 8:
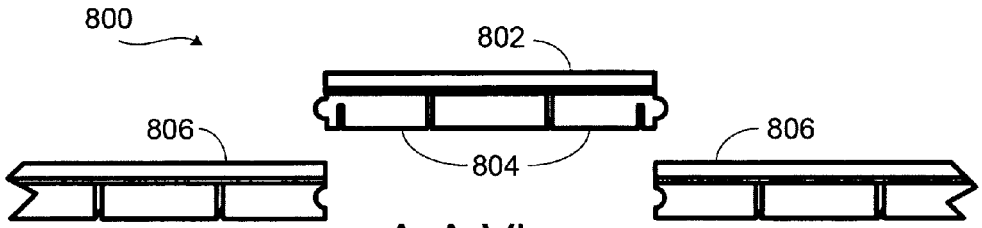
Figure 9:
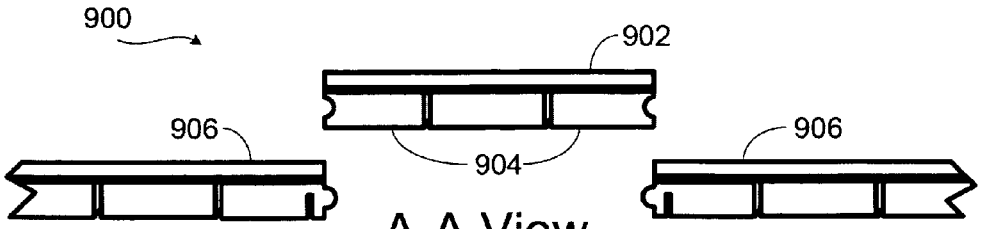

FIG. 7 illustrates cross section A-A view of an engagement of floor boards. Two adjacent floor boards 702 are engaged through use of the locking lip 304 and recessed slot 306 as shown in FIG. 3. To make assembling easier, a contraction slot 704 can be provided in the support strip. The contraction slot 704 defines the locking lip 304. The contraction slot 704 provides flexibility to the locking lip 304, allowing the locking lip 304 to retract when a floor board is being inserted between two floor boards. FIG. 8 depicts cross section A-A view of an alternative engagement of adjacent floor boards. Floor board 802 has two supporting strips 804 and each supporting strip 804 has locking lip 304 and a contraction slot 704. Floor boards 806, each has a recessed slot 306 for receiving the locking lips 304. FIG. 9 depicts cross section A-A view of another alternative engagement of adjacent floor boards. In FIG. 9, floor board 902 has supporting strips 904 with recessed slot 306 on both sides and floor boards 906 are equipped with locking lips 304 and contraction slots 704.

Figure 10:
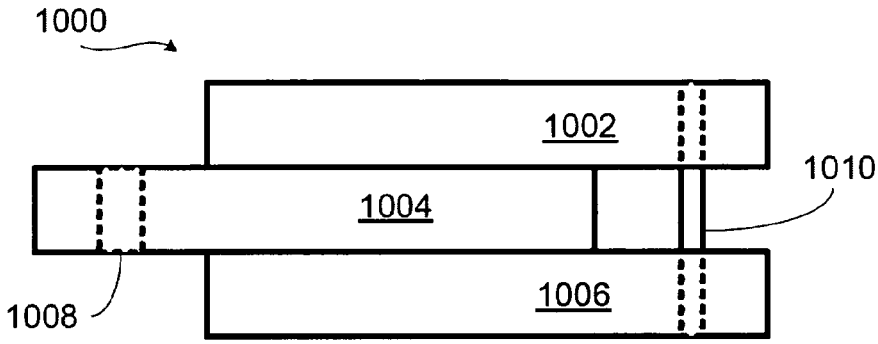
FIG. 10 depicts an alternative assembly of a composite panel.
Figure 11:
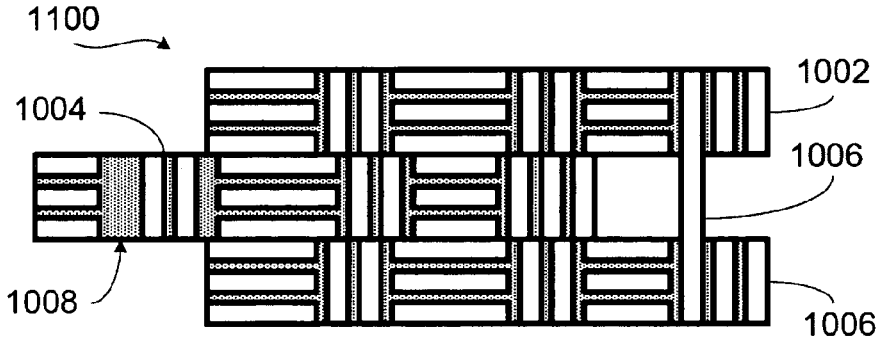
FIG. 11 depicts a bottom view of a composite panel with a locking rung.
Figure 12:
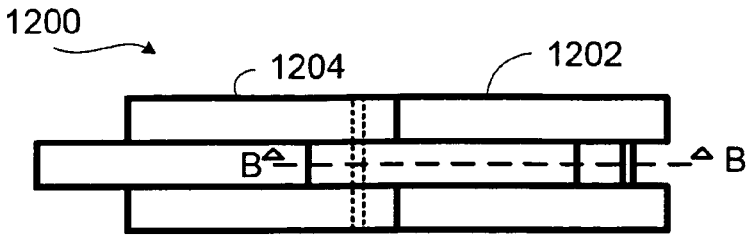
FIG. 12 depicts engagement of two adjacent composite panels.
Figure 13:
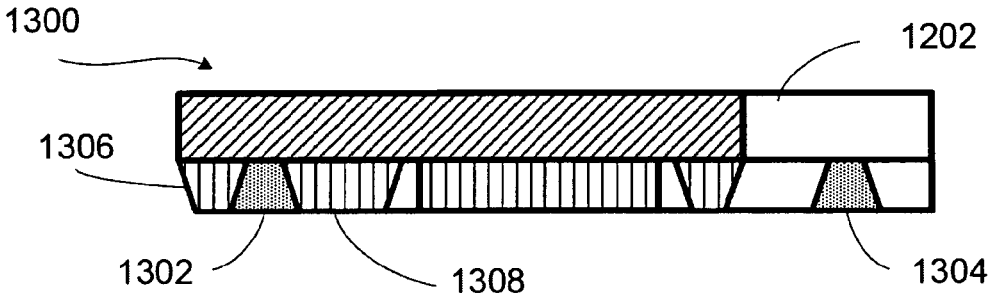
FIG. 13 depicts a cross section view of two engaged composite panels.

The installation of composite floor panels can be made easier and faster with an alternative composite floor panel 1000 shown in FIG. 10. The composite floor panel 1000 is composed by three floor boards 1002, 1004, and 1006. There is a rung 1010 connecting floor boards 1002 and 1006, and there is a recessed passage 1008 under floor board 1004. FIG. 11 is a bottom view 1100 of the composite floor panel 1000. Use of the rung 1010 and recessed passage 1008 enables easily installation of hardwood floor. FIG. 12 illustrates an assembly 1200 of the adjacent composite floor panels 1202, 1204 by overlaying the recessed passage 1008 of the composite floor panel 1202 on the top of the rung 1010 of the composite floor panel 1204. The rung 1010 is trapezoidally shaped and pressed against 1008 which can squeeze panel 1202 against panel 1204. FIG. 13 illustrates a cross section view 1300 of two adjacent composite floor panels shown in FIG. 12. The rung 1302 from the composite floor panel 1204 is fitted between supporting strips 1306 and 1308 of the composite floor panel 1202. The rung 1304 of the composite floor panel 1202 will engage the recessed passage 1008 of next adjacent composite floor panel. Preferably, the rungs 1302, 1304 are slightly shift toward left, so the rung 1302 will run against to the strip 1306, and this pushes panels 1202 and 1204 close together. Preferably, the rung is formed with a slot like slot 704 which make the rung 1306 flexible to grip strip 1302 or verse versa.

Figure 14:
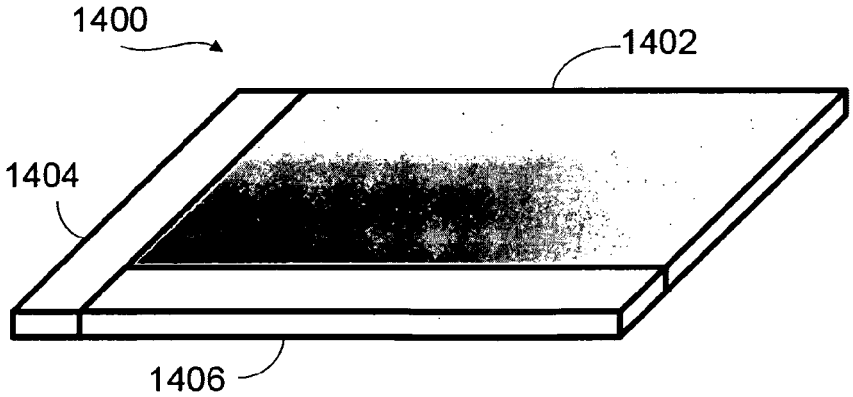
FIG. 14 depicts a water resistant floor tile according to one embodiment of the invention.
Figure 15:
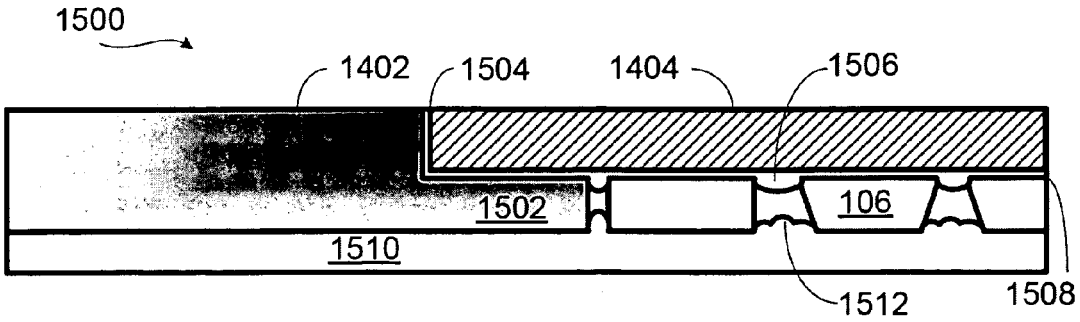
FIG. 15 depicts a cross section view of a water resistant floor tile according to the invention.
Figure 16:
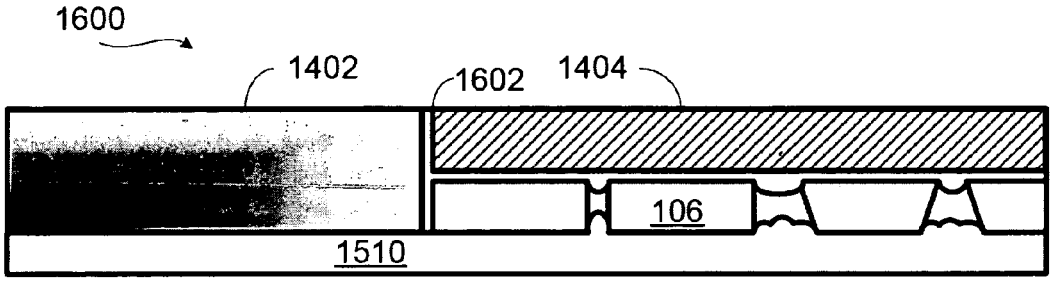
FIG. 16 depicts a cross section view of a water resistant floor tile according to an alternative embodiment of the invention.
Figure 17:
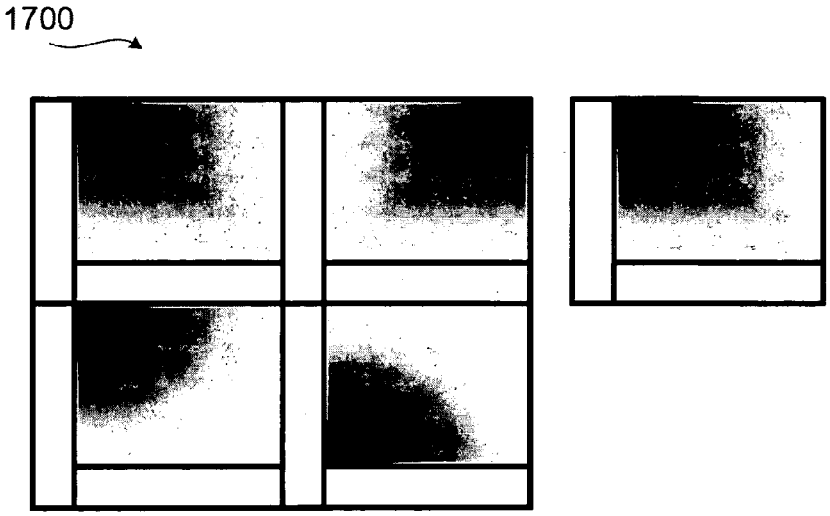
FIG. 17 illustrates a floor assembled with water resistant floor tiles of the invention.

FIG. 14 illustrates a HPE floor tile 1400 according to one embodiment of the present invention. The floor tile 1400 has a masonry tile 1402 section attached to two floor boards 1404, 1406. The masonry tile 1402 can be ceramic tile, porcelain tile, glass tile, stone, cement tile, brick in different shape such as square, rectangle, circular, triangle, polygon, diamond shape, etc. FIG. 15 illustrates a cross section view 1500 of a composite floor tile. The masonry tile 1402 has a recessed area 1502 onto which a floor board 1404 can be attached. The floorboard 1404 is supported by the supporting strips 106. The floor board 1404 can be glued through a glue layer 1508 or otherwise attached to the masonry tile 1402. The glue layer 1508 may extend vertically 1504 between the floor board 1404 and the masonry tile 1402. The glue layer 1508 may also include excess glue 1506 between the supporting strips 106. The floor tile is affixed onto a floor through a layer of mortar 1510. As the floor tile is pressed against the layer of mortar, the gap between the supporting strips 106 may be filled with mortar 1512. FIG. 16 illustrates a cross section view 1600 of an alternative embodiment of the composite floor tile. In this embodiment, the floor board 1404 is placed laterally to the masonry tile 1402. The masonry tile 1402 is not attached to the floor board 1404. The floor tiles shown in FIGS. 14-16 provide a good water resistant property because the floor board 1404 has a water resistant coating and is also isolated from bottom by a water resistant adhesive layer 1508 used to attach the water resistant supporting strip 106. FIG. 17 depicts a floor 1700 assembled with the water resistant floor tiles according to the present invention. The water resistant floor tiles can be easily installed using mortar as a regular ceramic tile or masonry tile. Different patterns and decorations can be arranged between the hardwood floor and tile/stone.

Figure 18A:
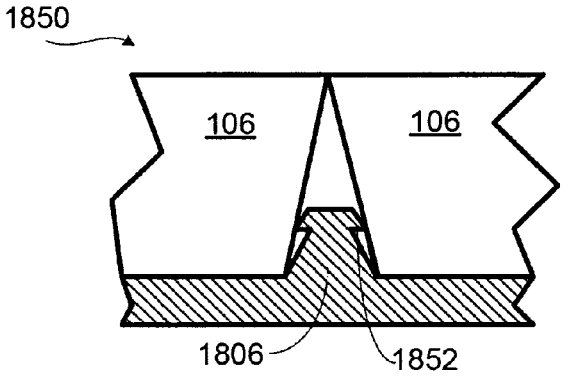
FIG. 18A is a detail view of engagement of a spacer and two supporting strips of FIG. 18.
Figure 19:
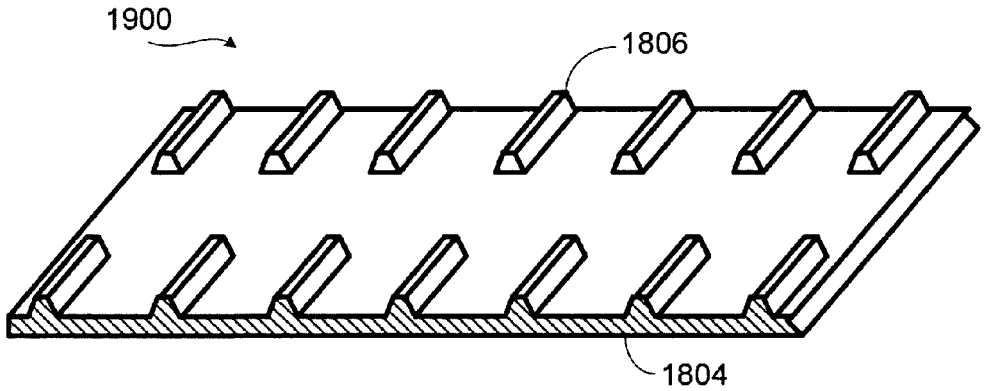
FIG. 19 is a perspective view of a underlayment according to one embodiment of the invention.

FIG. 18 depicts a cross section view 1800 of a floor assembled with floor boards 102. The floor boards 102 are installed on top of a special elastic underlayment 1804. The underlayment 1804 has a plurality of spacers 1806 distributed on its surface. Each supporting strip 106 is placed between two spacers 1806. The width w1 of the base of a supporting strip 106 is preferably a little bigger than the width w2 between two adjacent spacers 1806; so that each supporting strip 106 is securely held and compressed by two adjacent spacers 1806. The stretching of the base of the elastic underlayment 1804 from w2 to w1 will create pulling force between floor boards and thus eliminating any gaps between boards. FIG. 18A is a detail illustration 1850 of engagement between two supporting strips 106 and one spacer 1806. The spacer 1806 preferably has two teeth 1852, one facing each supporting strip 106. These teeth 1852 help to grip onto the supporting strip 106, such that a supporting strip 106 is held in place not only by the compression force from two adjacent spacers 1806, but also by the gripping force from the teeth 1852. The underlayment 1804 is made from an elastic material, such as rubber or soft plastic. FIG. 19 is a perspective view 1900 of the underlayment 1804 for floating floor assembly. The assembling process can be fast because there is no need to measure and align the floor boards 102; the floor boards 102 are assembled in predefined positions. The spacers 1806 will firmly tight two floor boards 102 together. Though the spacers 1806 are shown as having a short length, those skilled in the art will appreciate that the spacers 1806 may continuous and have a length that runs along the length of the underlayment 1804.

Figure 20:
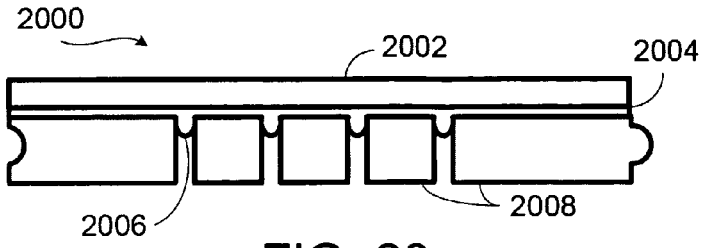
FIG. 20 depicts a cross section view of a HPE floor board with a water resistant adhesive layer.
Figure 21:
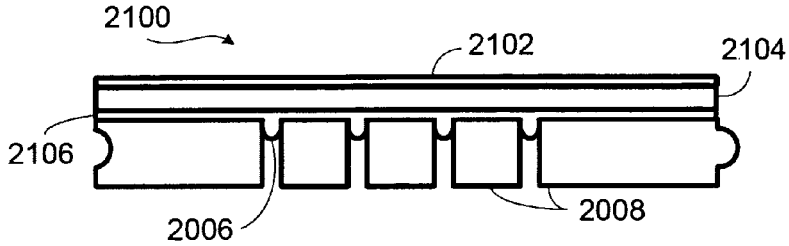
FIG. 21 depicts a cross section view of a HPE floor board with a supporting layer.

FIG. 20 depicts a HPE floor board 2000 with a water resistant adhesive layer. The water resistant floor board 200 has a top wood layer 2002 and a water resistant adhesive layer 2004 on which supporting strips 2008 are attached. The adhesive layer 2004 is a water barrier and preferably an excess of adhesive 2006 are placed between the supporting strips 2008. FIG. 21 depicts an alternative embodiment of a water resistant floor board 2100. The HPE floor board 2100 has a thin top wood layer 2102. The thickness of the top wood layer 2102 is preferably between 0.3-2 mm. The top wood layer 2102 is attached to a support layer 2104. The support layer 2104 has a thickness between 2-5 mm. By having this support layer 2104, the thickness of the top wood layer 2102 can be reduced. Since the top wood layer 2102 is generally made from high quality wood, savings can be achieved by minimizing the top wood layer 2102. The water resistant quality is preserved in the floor board 2100 with the water resistant adhesive layer 2106 and excess adhesive 2006 placed between the supporting strips 2008.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents. Dimensions in the drawings here presented are not to the scale unless otherwise indicated.

What is claimed is:

1. A high performance engineered wood floor board having a length, comprising:

a top wood layer with wood grain lined up along the length of the floor board, the top wood layer having a top surface and a bottom surface;

a plurality of supporting strips attached under the top wood layer, a first subset of the plurality of supporting strips being oriented in a first direction and a second subset of the plurality of supporting strips being oriented in a second direction, the first subset of the plurality of supporting strips being separated physically from and without being in contact with the second subset of the plurality of supporting strips wherein said top wood layer substantially covers the first and second subsets of supporting strips; and an adhesive layer placed between the top wood layer and the plurality of supporting strips, the adhesive layer covering the bottom surface of the top wood layer, wherein a first supporting strip in the plurality of supporting strips having a locking lip and a second supporting strip in the plurality of supporting strips having a recessed slot, the locking lip of the first supporting strip of the high performance engineering wood floor board being able to couple to the recessed slot of the second supporting strip of an adjacent high performance engineering wood floor board.

2. The high performance engineered wood floor board of claim 1, wherein the adhesive layer being a layer of water resistant glue.

3. The high performance engineered wood floor board of claim 1, wherein the plurality of supporting strips being attached transversely along the length of the floor board.

4. The high performance engineered wood floor board of claim 1, wherein at least a subset of the plurality of supporting strips being attached obliquely along the length of the floor board.

5. The high performance engineered wood floor board of claim 1, wherein the plurality of supporting strips being made from wood.

6. The high performance engineered wood floor board of claim 1, wherein the plurality of supporting strips being made from bamboo.

7. The high performance engineered wood floor board of claim 1, wherein the plurality of supporting strips being made from cement board.

8. The high performance engineered wood floor board of claim 1, wherein the plurality of supporting strips being made from silicate composite.

9. The high performance engineered wood floor board of claim 1, wherein the plurality of supporting strips being made from ceramic tile.

10. The high performance engineered wood floor board of claim 1, wherein the plurality of supporting strips being made from stone tile.

11. The high performance engineered wood floor board of claim 1, wherein the plurality of supporting strips being made from plastic.

12. The high performance engineered wood floor board of claim 1, wherein the plurality of supporting strips being made from wood/plastic composite.

13. The high performance engineered wood floor board of claim 1, wherein the plurality of supporting strips being made from man-made material.

14. A high performance engineered wood floor board comprising:

a top wood layer having a length; and a first plurality of supporting strips attached to the top wood layer, each supporting strip having at least one groove transversal to the length of the top wood layer, wherein a first supporting strip in the first plurality of supporting strips having a locking lip and a second supporting strip in the first plurality of supporting strips having a recessed slot, the locking lip of the first supporting strip of the high performance engineering wood floor board being able to couple to the recessed slot of the second supporting strip of an adjacent high performance engineering wood floor board wherein said top wood layer substantially covers the first and second subsets of supporting strips.

15. The high performance engineered wood floor board of claim 14, wherein the top wood layer further comprising a thin top layer and a base supporting wood layer glued longitudinally to the top thin layer along the length.

16. The high performance engineered wood floor board of claim 15, wherein the at least one groove being located on the bottom side of each supporting strips.

17. The high performance engineered wood floor board of claim 14, further comprising a second plurality of supporting strips placed transversally to the first plurality of supporting strips, wherein the first plurality of supporting strips being oriented in a first direction and the second plurality of supporting strips being oriented in a second direction, the first plurality of supporting strips being separated physically from and without being in contact with the second plurality of supporting strips.

18. The high performance engineered wood floor board of claim 14, further comprising a third plurality of supporting strips opposite of the top wood layer and embedded in a bottom surface of the first plurality of supporting strips.

* * * * *